US006581645B1

(12) United States Patent
Johnson et al.

(10) Patent No.: US 6,581,645 B1
(45) Date of Patent: Jun. 24, 2003

(54) WARP-TIED COMPOSITE FORMING FABRIC

(75) Inventors: Dale B. Johnson, Ottawa (CA); Ronald H. Seabrook, Stittsville (CA); Richard Stone, Carleton Place (CA)

(73) Assignee: AstenJohnson, Inc., Kanata (CA)

( * ) Notice: Subject to any disclaimer, the term of this patent is extended or adjusted under 35 U.S.C. 154(b) by 59 days.

(21) Appl. No.: 09/926,794

(22) PCT Filed: Jun. 27, 2000

(86) PCT No.: PCT/CA00/00763

§ 371 (c)(1),
(2), (4) Date: Dec. 20, 2001

(87) PCT Pub. No.: WO01/02634

PCT Pub. Date: Jan. 11, 2001

(30) Foreign Application Priority Data

Jun. 29, 1999 (GB) ..... 9915015

(51) Int. Cl.[7] ..... D03D 23/00; D03D 25/00

(52) U.S. Cl. ..... 139/383 A; 139/383 K; 139/384 R

(58) Field of Search ..... 139/383 R, 384 R, 139/408, 410, 383 A; 442/203, 205, 207

(56) References Cited

U.S. PATENT DOCUMENTS

| | | | | |
|---|---|---|---|---|
| 4,501,303 A | * | 2/1985 | Osterberg | 139/383 A |
| 4,515,853 A | | 5/1985 | Borel | |
| 4,605,585 A | * | 8/1986 | Johansson | 139/383 A |
| 4,729,412 A | | 3/1988 | Bugge | |
| 4,815,499 A | | 3/1989 | Johnson | |
| 4,945,952 A | | 8/1990 | Vohringer, I | |
| 4,967,805 A | | 11/1990 | Chiu, I | |
| 4,974,642 A | | 12/1990 | Taipale | |
| 4,987,929 A | | 1/1991 | Wilson | |
| 5,052,448 A | | 10/1991 | Givin | |
| 5,092,372 A | | 3/1992 | Fitzka et al. | |
| 5,152,326 A | | 10/1992 | Vohringer, II | |
| 5,158,117 A | | 10/1992 | Huhtiniemi | |
| 5,219,004 A | | 6/1993 | Chiu, II | |
| 5,379,808 A | | 1/1995 | Chiu, III | |
| 5,454,405 A | | 10/1995 | Hawes | |
| 5,482,567 A | | 1/1996 | Barreto | |
| 5,518,042 A | | 5/1996 | Wilson, II | |
| 5,544,678 A | | 8/1996 | Barrett | |
| 5,564,475 A | | 10/1996 | Wright | |
| 5,709,250 A | | 1/1998 | Ward et al. | |
| 5,826,627 A | * | 10/1998 | Seabrook et al. | 139/383 A |
| 5,881,764 A | * | 3/1999 | Ward | 139/383 A |

FOREIGN PATENT DOCUMENTS

| | | | |
|---|---|---|---|
| CA | 1 115 177 | | 12/1981 |
| DE | 3 742 101 | | 6/1989 |
| EP | 0 069 101 | A | 1/1983 |
| EP | 0 093 096 | A | 11/1983 |
| EP | 0 794 283 | A | 10/1997 |
| WO | WO 99 61698 | A | 12/1999 |
| WO | WO-99/61698 | * | 12/1999 |

* cited by examiner

*Primary Examiner*—Andy Falik
*Assistant Examiner*—Robert Muromoto, Jr.
(74) *Attorney, Agent, or Firm*—Robert A. Wilkes

(57) ABSTRACT

A composite forming fabric woven to a repeating pattern in at least 6 sheds; up to at least 36 sheds can be used. All of the paper side layer warp yarns are pairs of intrinsic warp binder yarns (101, 102) occupying an unbroken warp path in the paper side surface including three segments. The first and a second are occupied in turn by each intrinsic warp binder yarn (101, 102), and the third by both intrinsic warp binder yarns (101, 102) of a pair. The first, second and third segments are separated by at least one paper side layer weft, and a first or second segment is adjacent each end of the third segment. Within each first and second segment, each intrinsic warp binder yarn (101, 102) also interlaces once with a machine side layer weft (2', 9'), at the same point as a machine side layer warp (103) interlaces with the same weft (2', 9'). The weave path occupied by each member of a pair of intrinsic warp binder yarns (101, 102) can be the same or different. The segment lengths can be the same or different, and the machine side layer interlacing points can be regularly or irregularly spaced. After heat setting, the fabrics typically have a warp fill from about 110% to about 140%, an open area of at least 35% in the paper side surface, and an air permeability typically from about 3,500 to about 8,200 $m^3/m^2/hr$. Paper products made using these fabrics have enhanced printability.

27 Claims, 4 Drawing Sheets

WARP-TIED COMPOSITE FORMING FABRIC

FIELD OF THE INVENTION

The present invention relates to woven composite forming fabrics for use in papermaking machines. The term "composite forming fabric" refers to a forming fabric comprising two woven structures, which are the paper side layer and the machine side layer. Each of these layers is woven to a repeating pattern, and the two patterns used may be substantially the same or they may be different; at least one of the patterns includes the provision of binder yarns which serve to hold the two layers together. As used herein, such fabrics are distinct from those described, for example, by Johnson in U.S. Pat. No. 4,815,499 or Barrett in U.S. Pat. No. 5,544,678, which require additional binder yarns, in particular weft yarns, to interconnect the paper and machine side layers. In the composite forming fabrics of this invention, the paper side layer and the machine side layer are each woven to different, but related, weave patterns, and are interconnected by means of the paper side layer warp yarns.

BACKGROUND OF THE INVENTION

In composite forming fabrics that include two essentially separate woven structures, the paper side layer is typically a single layer woven structure which provides, amongst other things, a minimum of fabric wire mark to, and adequate drainage of liquid from, the incipient paper web. The paper side layer should also maximise planar support for the fibers and other paper forming solids in the paper slurry while providing sufficient open area to allow adequate drainage. The machine side layer is also typically a single layer woven structure, which should be tough and durable, provide a measure of dimensional stability to the composite forming fabric so as to minimize fabric stretching and narrowing, and sufficiently stiff to minimize curling at the fabric edges. It is also known to use double layer woven structures for either or both of the paper and machine side layers.

The two layers of a composite forming fabric are interconnected by means of either additional binder yarns, or intrinsic binder yarns. Additional binder yarns do not contribute significantly to the fundamental weave structure of the paper side surface of the paper side layer, and serve mainly to bind the two layers together. In comparison, intrinsic binder yarns both contribute to the structure of the paper side layer and also serve to bind together the paper and machine side layers of the composite forming fabric. The chosen yarns may be either warp or weft yarns. The paths of the yarns are arranged so that the selected yarns pass through both layers, thereby interconnecting them into a single composite fabric. Examples of prior art composite forming fabrics woven using intrinsic binder warp or weft yarns are described by Osterberg, U.S. Pat. No. 4,501,303; Bugge, U.S. Pat. No. 4,729,412; Chiu, U.S. Pat. No. 4,967,805, U.S. Pat. No. 5,291,004 and U.S. Pat. No. 5,379,808; Givin, U.S. Pat. No. 5,052,448; Wilson, U.S. Pat. No. 4,987,929 and U.S. Pat. No. 5,518,042; Ward et al, U.S. Pat. No. 5,709,250; Vohringer, U.S. Pat. No. 5,152,326; Johansson, U.S. Pat. No. 4,605,585; Hawes, U.S. Pat. No. 5,454,405; Wright, U.S. Pat. No. 5,564,475; and Seabrook et al, U.S. Pat. No. 5,826,627. Additional binder yarns have been generally preferred over intrinsic binder yarns for commercial manufacture of composite forming fabrics because they were thought to be less likely to cause discontinuities, such as dimples, in the paper side surface of the paper side layer.

Examples of prior art fabrics woven using additional binder yarns are described by Johansson et al., CA 1,115,177; Borel, U.S. Pat. No. 4,515,853; Vohringer, DE 3,742,101 and U.S. Pat. No. 4,945,952; Fitzka et al, U.S. Pat. No. 5,092,372; Taipale, U.S. Pat. No. 4,974,642; Huhtiniemi, U.S. Pat. No. 5,158,117; and Barreto, U.S. Pat. No. 5,482,567.

In composite forming fabrics where intrinsic warp binder yarns from the machine side layer have been used to interconnect the paper and machine side layers, the prior art has generally advocated modifying the path of the selected machine side layer warps so as to bring these yarns up to the paper side layer to interlace with it at selected weft knuckles. A known disadvantage associated with this practice is that the area immediately adjacent to these tie locations tends to become pulled down into the fabric structure, well below the plane of the adjacent knuckles, causing a deviation in the paper side surface of the paper side layer, commonly referred to as a "dimple". These dimples frequently create a pronounced unevenness in the paper side surface of the fabric, which can result in an unacceptable mark in any paper formed on the fabric. The residual impression made by the weave design of the forming fabric on the side of the paper sheet in contact with the fabric is referred to as "wire mark" or "mark".

In comparison, intrinsic weft binder yarns have been found to cause less paper side surface dimpling, and hence have been a preferred method of interconnecting the layers of composite forming fabrics. However, there are a number of problems associated with their use.

First, intrinsic weft binder yarns have been found to cause variations in the cross-machine direction mesh uniformity of the paper side surface of the paper side layer in certain weave patterns, resulting in an unacceptable level of wire mark in some grades of paper.

Second, fabrics woven using intrinsic weft binder yarns are known to be susceptible to lateral contraction, or narrowing, when in use. Lateral contraction may be defined as the degree to which a fabric narrows when machine direction (or longitudinal) tension is applied. If the fabric narrows excessively under this tension, particularly at driven rolls in the forming section, the resulting width changes will cause the fabric to buckle or form ridges. Generally, single layer fabrics, and composite fabrics having additional or intrinsic weft binder yarns, exhibit much higher degrees of lateral contraction than either double layer, or extra-support double layer, fabrics of comparable mesh.

Third, composite forming fabrics containing intrinsic weft binder yarns are less efficient to weave than comparable intrinsic warp binder designs, because a greater number of weft yarns is required to provide a reliable interconnection between the paper side layer and the machine side layer. Comparable fabrics whose designs utilise intrinsic warp binder yarns require fewer weft yarns per unit length, since none of the weft yarns is utilised to interconnect the paper and machine side layers. For example, a fabric containing intrinsic warp binder yarns whose paper side layer is woven so as to provide 31.5 weft yarns/cm, and 15.75 weft yarns/cm on its machine side layer (resulting in a 2:1 ratio of the paper side layer to machine side layer weft yarn count), has a total weft yarn count of 47.25 yarns/cm. A comparable fabric containing intrinsic weft binder yarns, woven at 31.5 weft yarns/cm in its paper side layer, at 15.75 weft yarns/cm in its machine side layer, and which employs additional weft yarns to interconnect the layers, has a total weft yarn count of between 55 to 63 weft yarns/cm, because additional weft yarns must be provided so as to tie the two layers together. Thus, composite forming fabrics that utilise intrinsic warp binder yarns to interconnect their paper and machine side layers require up to 25% fewer weft yarns to weave each unit length, making them more efficient to produce.

Fourth, a fabric utilizing intrinsic warp binder yarns will generally have a lower caliper (and provide a lower void volume) than a comparable fabric of similar specification utilizing intrinsic weft binder yarns. Because there are fewer weft yarns per unit length, those remaining do not contribute as much to the thickness of the fabric.

A benefit provided by composite fabrics utilizing intrinsic warp binder yarns is their increased resistance to delamination, when compared to a composite fabric utilizing either additional or intrinsic weft binder yarns. Delamination, which is the catastrophic separation of the machine and paper side layers, is generally caused by one of two mechanisms. The first is abrasion of the binder yarn where it is exposed on the machine side of the fabric as it passes in sliding contact over the various stationary elements in the forming section. In composite fabrics utilizing intrinsic warp binder yarns, it is possible to recess the warp binder yarns relative to the wear plane of the fabric to a greater degree (e.g. by as much as 0.05–0.076 mm further away from the wear plane) than is possible in a comparable fabric utilizing intrinsic weft binder yarns. This means that more machine side layer warp and weft yarn material must be abraded away from the running side of a fabric utilizing intrinsic warp binder yarns before the tie strands are broken, and the two layers delaminate, than in a comparable fabric utilizing intrinsic weft binder yarns.

The second delamination mechanism, which is encountered more rarely than the first, is that of internal abrasion of the binder yarns between the machine and paper side layers as they flex or shift relative to one another. The presence of abrasive fillers in the stock, such as clay, titanium dioxide and calcium carbonate, greatly exacerbates the rate of this type of abrasion. Composite forming fabrics whose paper and machine layers are well interlaced so as to prevent or reduce relative movement of these layers (such as in the fabrics of the present invention utilizing intrinsic warp binder yarns) will experience less internal abrasion than comparable fabrics utilizing intrinsic weft binder yarns. They are therefore less susceptible to delamination by internal abrasion.

Accordingly, the present invention seeks to provide a composite forming fabric whose construction is intended at least to ameliorate the aforementioned problems of the prior art.

The present invention further seeks to provide a composite forming fabric having reduced susceptibility to cross-machine direction variations in the paper side layer mesh uniformity than comparable fabrics of the prior art.

Additionally, this invention seeks to provide a composite forming fabric that is resistant to lateral contraction.

This invention also seeks to provide a composite forming fabric that is more efficient to weave than comparable fabrics utilizing intrinsic weft binder yarns to interconnect the paper and machine side layer woven structures.

Furthermore, this invention seeks to provide a composite forming fabric that is less susceptible to dimpling of the paper side surface.

In a preferred embodiment, this invention seeks to provide a composite forming fabric having a lower void volume than a comparable forming fabric utilizing intrinsic weft binder yarns.

This invention additionally seeks to provide a composite forming fabric that is resistant to delamination.

SUMMARY OF THE INVENTION.

In a first broad embodiment the present invention seeks to provide a composite forming fabric comprising in combination a paper side layer having a paper side surface, a machine side layer, and paper side layer intrinsic warp binder yarns which bind together the paper side layer and the machine side layer, wherein:

(i) the paper side layer and the machine side layer each comprise warp yarns and weft yarns woven together in a repeating pattern, and the paper side layer and the machine side layer together are woven in at least 6 sheds;

(ii) in the paper side layer all of the warp yarns comprise pairs of intrinsic warp binder yarns;

(iii) in the paper side surface of the paper side layer the repeating pattern provides a warp yarn path in which the paper side layer warp yarn floats over 1, 2 or 3 consecutive paper side layer weft yarns;

(iv) each of the pairs of intrinsic warp binder yarns occupy the unbroken warp path in the paper side layer;

(v) the ratio of paper side layer weft yarns to machine side layer weft yarns is chosen from 1:1, 2:1, 3:2, and 3:1; and (vi) the ratio of paper side layer warp yarns to machine side layer warp yarns is chosen from 1:1 to 3:1; and wherein the pairs of intrinsic warp binder yarns comprising all of the paper side layer warp yarns are woven such that:

(a) in a first segment of the unbroken warp path:

(1) the first member of the pair interweaves with a first group of paper side layer wefts to occupy a first part of the unbroken warp path in the paper side surface of the paper side layer;

(2) the first member of the pair floats over 1, 2 or 3 consecutive paper side layer weft yarns; and (3) the second member of the pair interlaces with one weft yarn in the machine side layer beside a machine side layer warp yarn that interlaces with the same machine side layer weft yarn;

(b) in a second segment of the unbroken warp path:

(1) the second member of the pair interweaves with a second group of paper side layer wefts to occupy a second part of the unbroken warp path in the paper side surface of the paper side layer;

(2) the second member of the pair floats over 1, 2 or 3 consecutive paper side layer weft yarns; and (3) the first member of the pair interlaces with one weft yarn in the machine side layer beside a machine side layer warp yarn that interlaces with the same machine side layer weft yarn;

(c) in a third segment of the unbroken warp path:

(1) the first member of the pair interweaves with a third group of paper side weft yarns;

(2) the second member of the pair interweaves with the same third group of paper side weft yarns;

(3) both the first member and the second member each independently float over 1, 2 or 3 consecutive paper side weft yarns; and (4) both the first member and the second member together occupy a third part of the unbroken warp path;

(d) in the paper side layer the unbroken warp path includes at least one first segment, at least one second segment, and at least one third segment, and at least one first or second segment is located between each of the third segments;

(e) the first, second and third segments are of equal or unequal length;

(f) the unbroken warp path in the paper side surface of the paper side layer occupied in turn by the first and the second member of each pair of intrinsic warp binder yarns has a single repeat pattern;

(g) in the unbroken warp path in the paper side surface of the paper side layer occupied in turn by the first and second members of each pair of intrinsic warp binder yarns, each succeeding segment is separated in the paper side surface of the paper side layer by at least one paper side layer weft yarn; and (h) in the composite fabric the weave pattern of the first member of a pair of intrinsic warp binder yarns is the same, or different, to the weave pattern of the second member of the pair.

In a preferred embodiment of this invention, the fabric as woven and prior to heat setting has a warp fill of from 100% to 125%.

In further preferred embodiments of this invention, the fabric after heat setting has a paper side layer having an open area, when measured by a standard test procedure, of at least 35%, the fabric has a warp fill of from 110% to 140%, and the fabric has an air permeability, when measured by a standard test procedure, of from less than about 8,200 $m^3/m^2/hr$, to as low as about 3,500 $m^3/m^2/hr$ at a pressure differential of 127 Pa through the fabric. An appropriate test procedure for determining fabric air permeability is ASTM D 737-96. Paper side layer open area is determined by the method described in CPPA Data Sheet G-18 using a plan view of this layer of the fabric.

It is a requirement of this invention that every paper side layer warp yarn comprises a pair of intrinsic warp binder yarns; each member of each pair alternately forms a portion of the unbroken warp path in the paper side surface weave pattern. Within each repeat of the composite fabric overall weave pattern, each paper side layer intrinsic warp binder yarn passes into the machine side layer to interlace at least once with a machine side layer weft, or wefts, so as to bind the paper side layer and the machine side layer together into a coherent composite fabric. The location at which each paper side layer intrinsic warp binder yarn interlaces with one machine side layer weft yarn is chosen to coincide with a knuckle formed by the interlacing of a machine side layer warp yarn with a machine side layer weft yarn.

In a preferred embodiment, within each repeat of the composite fabric weave pattern, at every machine side weft knuckle two warp yarns interlace with the machine side layer weft; one is a machine side layer warp, and the other is a paper side layer intrinsic warp binder yarn.

It can thus be seen that in the fabrics of this invention the paper side layer does not contain any conventional warp yarns which interlace only with paper side layer weft yarns. All of the paper side layer warp yarns are provided by the pairs of paper side layer intrinsic warp binder yarns, which, in addition to occupying the unbroken warp path in the paper side surface of the paper side layer, also bind the paper side layer and the machine side layer together.

Preferably, in the unbroken warp path in the paper side layer each segment occurs once within each complete repeat of the composite forming fabric weave pattern. Alternatively, in the unbroken warp path in the paper side layer each segment occurs more than once, for example twice, within each complete repeat of the composite forming fabric weave pattern.

Preferably, each first, second and third segment in the unbroken warp path in the paper side surface of the paper side layer is separated from an adjacent first or second segment by either 1, 2 or 3 paper side layer weft yarns. Preferably, each first, second and third segment in the unbroken warp path in the paper side surface of the paper side layer is separated from an adjacent first or second segment by one paper side layer weft yarn. Alternatively, each first, second and third segment in the unbroken warp path in the paper side surface of the paper side layer is separated from an adjacent first or second segment by two paper side layer weft yarns.

Preferably, within the paper side layer weave pattern, the first and second segment lengths formed by each of a pair of intrinsic warp binder yarns occupying the unbroken warp path are identical. Alternatively, the first and second segment lengths formed by each of a pair of intrinsic warp binder yarns occupying the unbroken warp path are not identical.

Preferably, within the composite fabric weave pattern the paths occupied by each of a pair of paper side layer intrinsic warp binder yarns are the same, and the interlacing points between the intrinsic warp binder yarns with the machine side layer wefts are regularly spaced, and are the same distance apart. Alternatively, within the composite fabric weave pattern the paths occupied by each of a pair of paper side layer intrinsic warp binder yarns are not the same, and the interlacing points between the intrinsic warp binder yarns with the machine side layer wefts are not regularly spaced, and are not the same distance apart. Preferably, within the composite fabric the weave design is chosen such that:

(1) the first, second and third segment lengths in the paper side layer are the same, and the interlacing points between the intrinsic warp binder yarns with the machine side layer wefts are regularly spaced; or (2) the first, second and third segment lengths in the paper side layer are the same, and the interlacing points between the intrinsic warp binder yarns with the machine side layer wefts are not regularly spaced, and are not the same distance apart; or (3) the first, second and third segment lengths in the paper side layer are not the same, and the interlacing points between the intrinsic warp binder yarns with the machine side layer wefts are not regularly spaced, and are not the same distance apart; or (4) the first and second segment lengths in the paper side layer are the same, and are different from the third segment length, and the interlacing points between the intrinsic warp binder yarns with the machine side layer wefts are regularly spaced;

(5) the first and second segment lengths in the paper side layer are the same, and are different from the third segment length, and the interlacing points between the intrinsic warp binder yarns with the machine side layer wefts are not regularly spaced;

(6) the first and third segment lengths are the same, and are different from the second segment length, and the interlacing points between the intrinsic warp binder yarns with the machine side layer wefts are regularly spaced; or (7) the first and third segment lengths are the same, and are different from the second segment length, and the interlacing points between the intrinsic warp binder yarns with the machine side layer wefts are not regularly spaced.

It is to be noted that within these preferred designs, both (6) and (7) are equally applicable when the second and third segment lengths are the same, and are different from the first segment length.

Preferably, the paper side layer weave pattern is chosen from a plain 1×1 weave; a 1×2 weave; a 1×3 weave; a 1×4 weave; a 2×2 basket weave; a 3×6 weave; a 4×8 weave; a 5×10 weave; or a 6×12 weave. Preferably, the weave design of the machine side layer is an N×2N design such as is disclosed by Barrett in U.S. Pat. No. 5,544,678. Alternatively, the paper side layer may be combined with a machine side layer woven according to a satin, twill, or broken twill design.

Preferably, the ratio of the number of paper side layer weft yarns to machine side layer weft yarns in the composite forming fabric is chosen from 1:1, 2:1, 3:2 or 3:1.

Preferably, the ratio of paper side layer warp yarns to machine side layer warp yarns is either 1:1, 2:1 or 3:1, allowing for the fact that each intrinsic warp binder pair equates to a single paper side layer warp yarn. More preferably, the ratio is 1:1.

A composite forming fabric according to this invention will be woven to a pattern requiring from at least 6 sheds, and up to at least as many as 36 sheds. The number of sheds required to weave the composite fabric is equal to the number of sheds required to weave each of the paper side layer and the machine side layer designs within the overall pattern repeat of the composite fabric.

Generally, the number of sheds required to weave the paper side layer weave pattern will be an integral multiple of the number of sheds required to weave the machine side layer weave pattern. The value of the multiplier will be dependant upon the ratio of the number of paper side layer warps to machine side layer warps in the composite fabric. The number of sheds required to weave the paper side layer generally will be at least twice the number required to weave the machine side layer. This ratio can only be 1:1, that is, the same number of sheds to weave both the paper side layer and the machine side layer, when the machine side layer weave pattern is woven using twice the minimum number of sheds normally required. For example, if a 4-shed machine side layer weave pattern is woven in 8 sheds, the number of sheds to weave the paper side layer will be at least 8.

Table 1 summarizes some of the possible paper side layer and machine side layer weave pattern combinations, together with the shed requirements for each.

TABLE 1

| PSL Weave | PSL Sheds, A | MSL Weave | MSL Sheds, B | Total Sheds | Ratio A:B |
|---|---|---|---|---|---|
| 1 × 1 | 12 | 6 × 6 | 12 | 24 | 1:1 |
| 1 × 1 | 12 | 6 × 6 | 6 | 18 | 2:1 |
| 1 × 1 | 12 | 6 × 12 | 6 | 18 | 2:1 |
| 1 × 2 | 12 | 6 × 12 | 6 | 18 | 2:1 |
| 1 × 1 | 4 | 1 × 1 | 2 | 6 | 2:1 |
| 1 × 2 | 6 | 1 × 2 | 3 | 9 | 2:1 |
| 3 × 6 | 6 | 1 × 2 | 3 | 9 | 2:1 |
| 3 × 6 | 12 | 6 × 12 | 6 | 18 | 2:1 |
| 1 × 1 | 8 | 1 × 3 | 4 | 12 | 2:1 |
| 4 × 8 | 8 | 1 × 3 | 4 | 12 | 2:1 |
| 1 × 1 | 8 | 1 × 3 | 8 | 16 | 1:1 |
| 4 × 8 | 8 | 4 × 8 | 4 | 12 | 2:1 |
| 4 × 8 | 16 | 1 × 3 | 4 | 20 | 4:1 |
| 4 × 8 | 16 | 4 × 8 | 4 | 20 | 4:1 |
| 1 × 1 | 20 | 5 × 5 | 5 | 25 | 4:1 |
| 3 × 6 | 12 | 1 × 2 | 3 | 15 | 4:1 |

In the headings to Table 1, "PSL" indicates paper side layer, and "MSL" indicates machine side layer.

Because all of the pairs of intrinsic warp binder yarns making up the paper side layer warp yarns are utilized to interlace with machine side layer weft yarns, this interlacing pattern improves fabric modulus, thus making the composite fabric more resistant to stretching and distortion, while reducing lateral contraction and any propensity for fabric layer delamination.

An important distinction between prior art fabrics and those of the present invention is the total warp fill, which is given by warp fill=(warp diameter×mesh×100)%. Warp fill can be determined either before or after heat setting, and, for the same fabric, is generally somewhat higher after heat setting. In all prior art composite fabrics, prior to heat setting, the sum of the warp fill in the paper side and machine side layers combined is typically less than 95%. The fabrics of this invention prior to heat setting have a total warp fill that preferably is greater than 100%, and is typically from 105% to about 125%. After heat setting, the fabrics of this invention have a total warp fill that preferably is greater than 110%, and is typically from about 110% to about 140%. This makes them unique. Another difference, associated with this level of warp fill, is that the mesh count of the paper side layer of the fabrics of this invention is at least twice that of the machine side layer. For example, one fabric of this invention was woven using 0.13 mm diameter warp and weft yarns to provide a paper side layer mesh (warp×weft) of 54.4×31.5 yarns/cm (counting each of the intrinsic warp binder yarn pair members); the machine side layer was woven using 0.17 mm diameter warp yarns and 0.33 mm diameter weft yarns to provide a machine side layer mesh of 27.2×15.75 yarns/cm. The resulting fabric had a total of 81.6 warp yarns/cm (54.4+27.2), and a total warp fill of 117% after heat setting.

In the context of this invention certain definitions are important.

The term "unbroken warp path" refers to the path in the paper side layer, which is visible on the paper side surface of the fabric, of the pairs of intrinsic warp binder yarns comprising all of the paper side layer warp yarns, and which is occupied in turn by each member of the pairs making up the intrinsic warp binder yarns.

The term "segment" refers to the portion of the unbroken warp path occupied by a specific intrinsic warp binder yarn, or by a pair of specific intrinsic warp binder yarns, and the associated term "segment length" refers to the length of a particular segment, and is expressed as the number of paper side layer weft yarns with which a member of a pair of intrinsic warp binder yarns interweaves, or both members of a pair of intrinsic warp binder yarns interweaves simultaneously, within the segment.

The term "float" refers to a yarn which passes over a group of other yarns without interweaving with them; the associated term "float length" refers to the length of a float, expressed as a number indicating the number of yarns passed over.

The term "interlace" refers to a point at which a paper side yarn wraps about a machine side yarn to form a single knuckle, and the associated term "interweave" refers to a locus at which a paper side yarn forms a plurality of knuckles with other paper side yarns along a portion of its length.

BRIEF DESCRIPTION OF THE DRAWINGS

The invention will now be described by way of reference to the drawings, in which.

Figure 1:
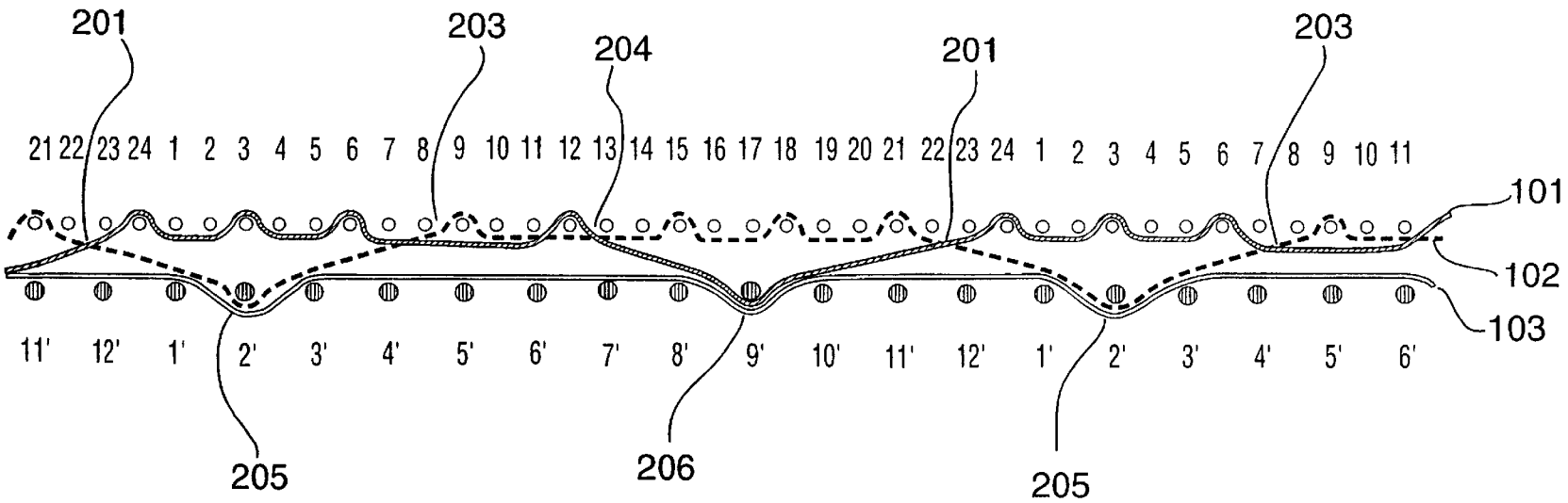
FIG. 1 is a cross sectional view of one embodiment of a composite forming fabric according to the invention showing the paths of one pair of intrinsic warp binder yarns in approximately one and one-half repeats of the composite forming fabric weave pattern.
Figure 3:
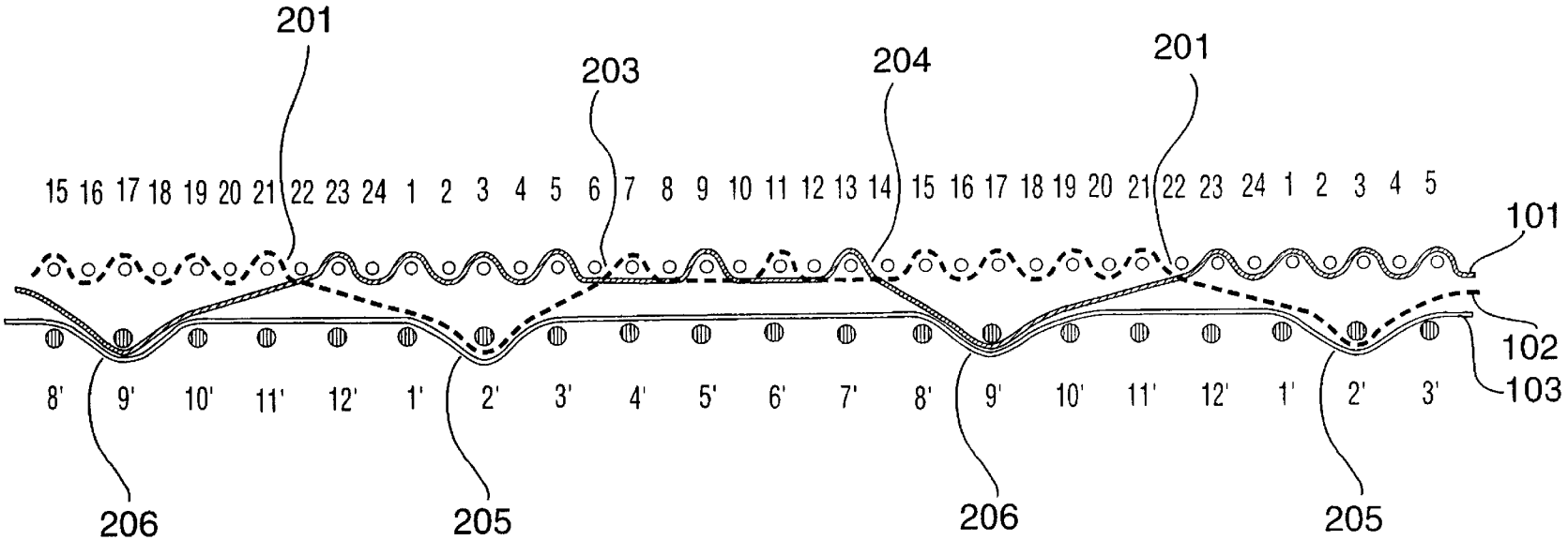
FIG. 3 is a cross sectional view of a second embodiment of a composite forming fabric according to the invention showing the paths of one pair on intrinsic warp binder yarns in approximately one and one-half repeats of the composite forming fabric weave pattern.

In each of the cross sectional views of FIGS. 1 and 3, the cut paper side layer weft yarns toward the top of the cross section are numbered from 1 to 24 in one repeat of the weave pattern, and the cut machine side layer wefts towards the bottom of the cross section are numbered from 1' to 12' in the same repeat. The same weave pattern continues towards both the left and the right of the Figure in each case, so that, for example, in FIG. 1 the next weave repeat begins on the right at 1 and 1'.

Figure 2:
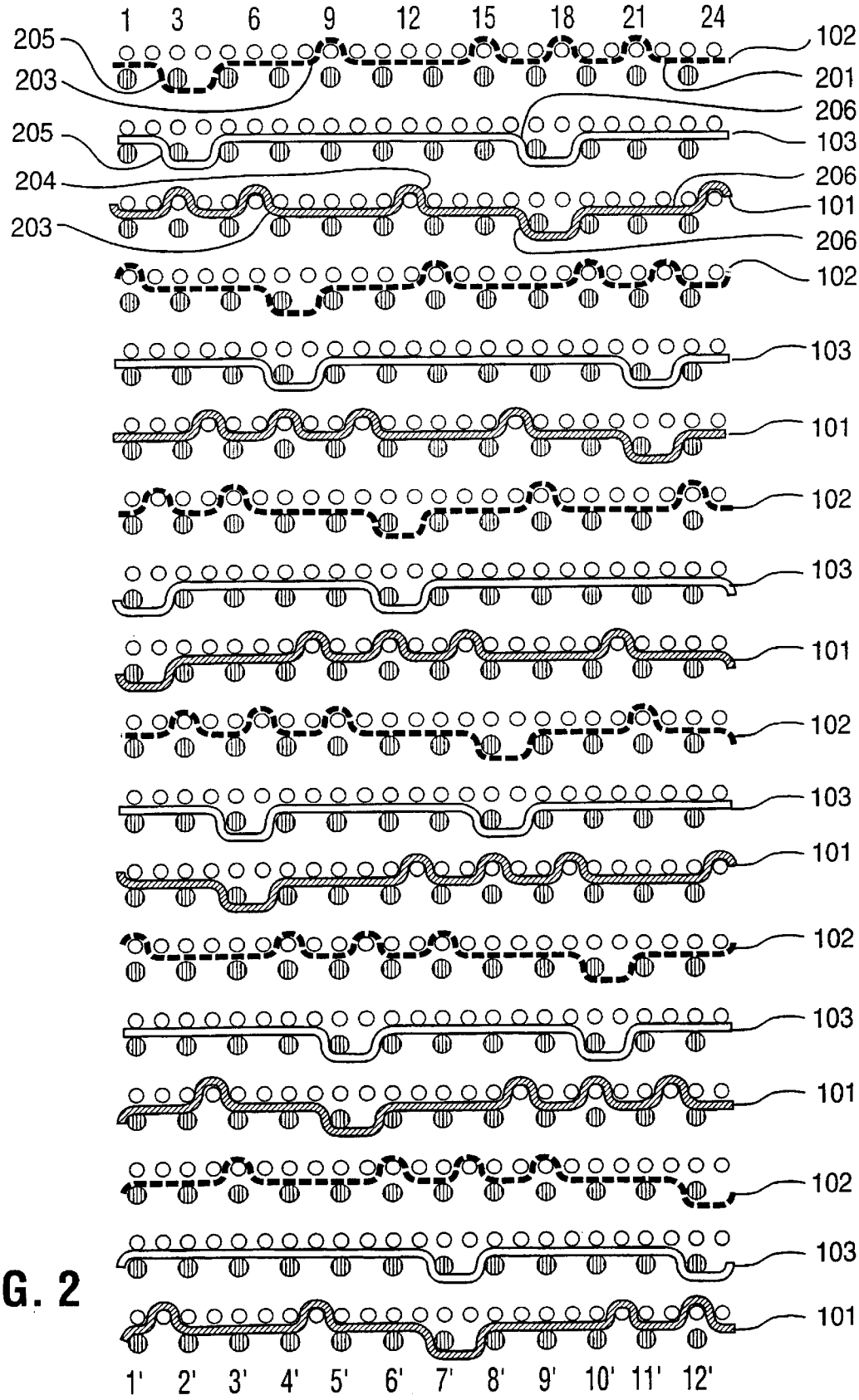
FIG. 2 is a weave diagram of the fabric whose cross section is illustrated in FIG. 1.
Figure 4:
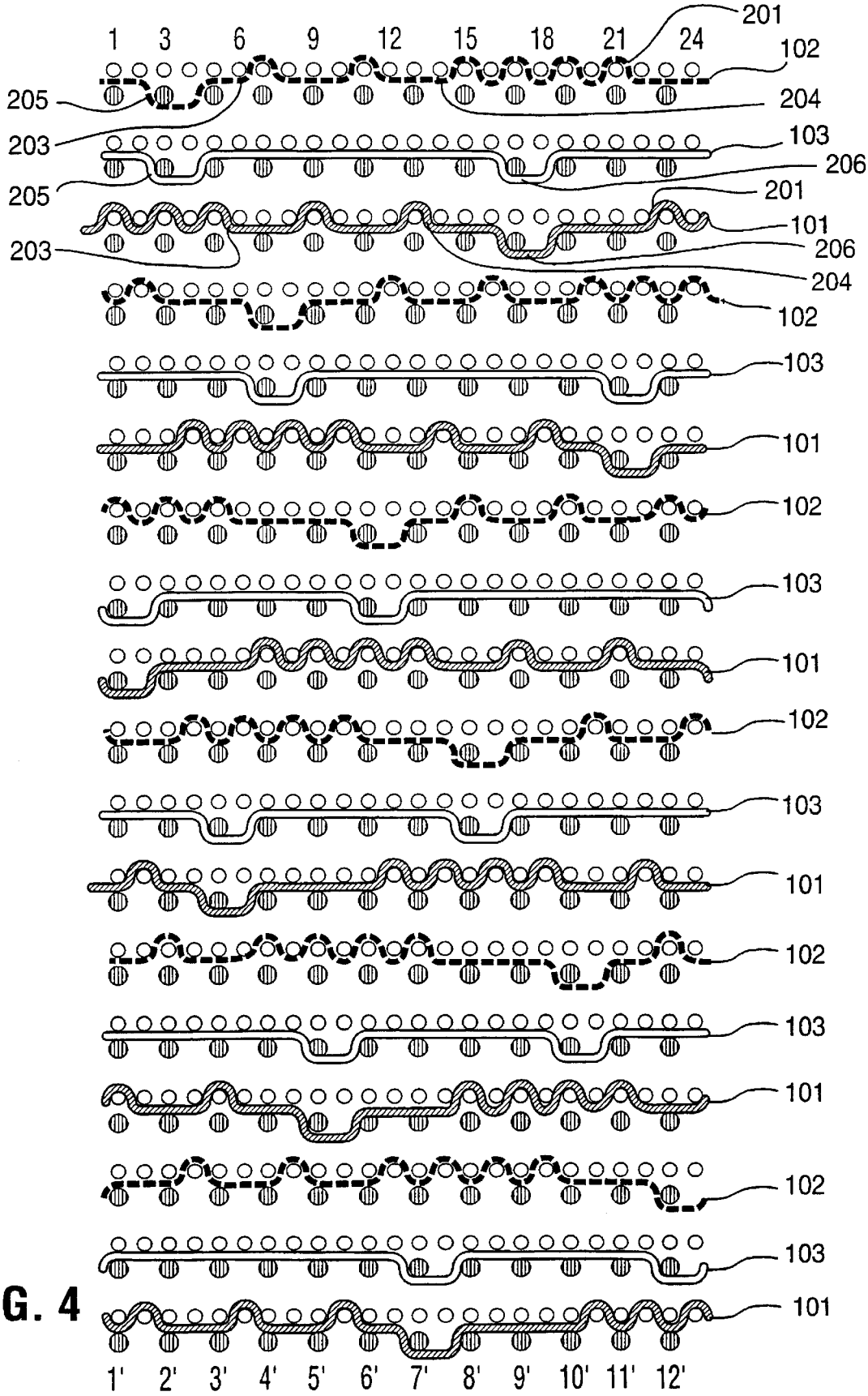
FIG. 4 is a weave diagram of the fabric whose cross section is illustrated in FIG. 3.

In each of the weave diagram views FIGS. 2 and 4, cross sections are shown along all of the warps, for both the paper side layer and the machine side layer separately for one full weave pattern repeat of a composite forming fabric according to the invention. The cut paper side layer weft yarns are again at the top, and the machine side layer weft yarns are again at the bottom in each of the cross sections.

DETAILED DESCRIPTION OF THE FIGURES

FIG. 1 is a cross sectional illustration of a first embodiment of a composite forming fabric according to the present invention, taken along the line of one of the intrinsic warp binder yarn pairs. In FIG. 1, the paper side layer intrinsic warp binder yarn pair members are 101 and 102, and the machine side layer warp yarn is 103. The paper side layer weft yarns are numbered 1 to 24, and the machine side layer weft yarns are numbered 1' to 12'. FIG. 1 shows approximately one and one half repeats of the weave pattern of the composite forming fabric; one full repeat of the weave pattern is shown between paper side layer weft yarns 1 through 24.

In this embodiment, the paper side layer is woven according to a 3-shed, 2×1 twill design. The machine side layer is woven in 6 sheds according to a 6×12 design as described by Barrett in U.S. Pat. No. 5,544,678. The composite forming fabric is woven in 18 sheds, 12 for the paper side layer, and 6 for the machine side layer. It is also possible to weave this fabric using 24 sheds, 12 for each of the paper side layer and machine side layer patterns. The paper side layer to machine side layer weft ratio is 2:1. Bearing in mind that each intrinsic warp binder pair is counted as a single yarn, the paper side layer to machine side layer warp ratio is 1:1, and every paper side layer warp comprises a pair of intrinsic warp binder yarns. The weave diagram of this fabric is shown in FIG. 2.

It will be apparent from FIGS. 1 and 2 that the unbroken warp path formed by the intrinsic warp binder yarn pair members is comprised of three distinct segments. The first segment is formed by the interweaving of intrinsic warp binder yarn pair member 101 with a first group of paper side layer weft yarns so as to occupy a first part of the unbroken warp path in the paper side surface of the paper side layer; this first segment occupies the portion of the paper side surface from 201 to 203, involving weft yarns 24 to 6. The second segment is formed by the interweaving of intrinsic warp binder yarn pair member 102 with a second group of paper side layer weft yarns so as to occupy a second part of the unbroken warp path in the paper side surface of the paper side layer; this second segment occupies the portion of the paper side surface from 204 to 201, involving weft yarns 15 to 21. The third segment is formed by the interweaving of both the first and second intrinsic warp binder yarn pair members 101 and 102 together with a third group of paper side layer weft yarns so as to occupy a third part of the unbroken warp path in the paper side surface of the paper side layer; this third segment occupies the portion of the paper side surface from 203 to 204, involving weft yarns 9 to 12.

Starting from the left side of FIG. 1 at 201, first warp yarn pair member 101 rises from the machine side layer and exchanges positions with the second pair member 102 beneath wefts 22 and 23 at 201. Warp 101 then forms the first segment of the unbroken warp path in the paper side surface of the paper side layer weave pattern as it interweaves with a first group of paper side layer wefts, passing over weft 24, beneath wefts 1 and 2, over weft 3, beneath wefts 4 and 5, then over weft 6, to form a portion of the 3-shed, 2×1 twill design to which the paper side layer of the composite forming fabric is woven. Warp 101 then passes beneath wefts 7 and 8 where it exchanges positions at 203 with weft 102. The length of this first segment is thus 7 weft yarns, including wefts 24, 1, 2, 3, 4, 5 and 6. Inspection of this first segment also shows that the second member of the warp yarn pair members, warp 102, interlaces with one machine side layer weft yarn 2' at 202 beside machine side layer warp yarn 103 which also interlaces with the same machine side layer weft yarn 2'. This assists in recessing warp 102 from the wear plane of the fabric, and increases the wear potential of the fabric.

The second segment of the unbroken warp path in the paper side surface of the paper side layer is formed by intrinsic warp binder yarn pair member 102 and occupies the portion of the unbroken warp path in the paper side surface of the paper side layer that commences at 204 and terminates towards the right side of FIG. 1 at 201. Warp 102 interweaves with a second group of paper side layer weft yarns, passing over weft 15, beneath weft 16 and 17, over weft 18, beneath weft 19 and 20 and over weft 21 to also form a portion of the 3-shed, 2×1 twill design of the paper side layer. The second segment ends where warp 102 passes beneath weft 22 and exchanges positions with warp 101 as it proceeds down into the machine side layer. The second segment is equal in length to the first segment and includes 7 weft: 15, 16, 17, 18, 19, 20 and 21. It will also be seen in this second segment, that the second of the intrinsic warp binder yarn pair members, warp 101, interlaces with one machine side layer weft yarn 9' at 206 beside machine side layer warp yarn 103 which also interlaces with the same machine side layer weft yarn 91. As described above, this arrangement assists in recessing warp 101 from the wear plane of the fabric, and increases the wear potential of the fabric.

The third segment of the unbroken warp path in the paper side surface of the paper side layer is located between 203 and 204. This third segment is formed by the interweaving of the first intrinsic warp binder yarn pair member 101, and the second warp yarn pair member 102, with a third group of weft yarns 9, 10, 11 and 12 so as to form jointly a portion of the 3-shed, 2×1 twill design of the paper side layer. Thus, both the first and second intrinsic warp binder yarn pair members together occupy this third segment of the warp yarn path. This arrangement is distinct from that of the first and second segments, wherein each is occupied solely by one of the warp yarn pair members. In every third segment, the first member of the intrinsic warp binder yarn pair interweaves with a third group of weft yarns, the second member of the pair interweaves with the same third group of paper side layer weft yarns, to provide the same overall paper side layer weave pattern as both the first and second segments so that although both of the first and second member are involved in the third segment, the paper side surface weave pattern appears to continue without any apparent interruption.

Within this third segment, beginning at 203, intrinsic warp binder yarn 102 passes over weft 9, then under wefts 10, 11 and 12. Intrinsic warp binder yarn 101 passes beneath wefts 9, 10, and 11 and passes over weft 12, thereby continuing, together with warp 102, the unbroken warp path. This third segment ends at 204 where warp 101 passes down from the paper side layer to interlace with machine side layer weft 9' at 205. The length of the third segment is thus 4, including weft yarns 9, 10, 11 and 12. There are 2 weft yarns between this third segment and the adjacent first and second segments; weft 7 and 8 at the left, and weft 13 and 14 at the right. Within the unbroken warp path pattern repeat the segment sequence is first, third, then second, so that there is a first and a second segment between each succeeding third segment.

Three features of the composite fabrics of this invention are visible in this cross section.

First, although the first and second segment lengths are the same and are both equal to seven, the third segment is shorter and its length is 4. This is not necessary, and other combinations of segment lengths are possible. For example, the first, second and third segments may all be of equal length. Alternatively, the first and second segments may be of differing lengths, and neither equal to the third. As a further alternative, the first and second segment lengths may differ, while the length of the third segment may be equal to one of either the first or second.

Second, there are two paper side layer weft yarns between each of the first, second and third segments. In FIG. 1, these are: weft 7 and 8 between the first and third segments, weft 13 and 14 between the third and second segments, weft 22 and 23 between the second and first segments. Depending on the weave design chosen for the paper side layer, there may be either one, two or three weft yarns intervening between each of the segments, but there must be at least one weft yarn between each of the segments.

Third, each of the paper side layer intrinsic warp binder yarn pair members 101 and 102 pass beneath and interlace with separate machine side layer weft yarns which are located at different points in the weave pattern of the machine side layer. In this fabric, all of the interlacing points are chosen to coincide with separate knuckles formed by the interlacing of the machine side layer weft yarns with the machine side layer warp yarns. Within each repeat of the composite fabric weave pattern, at every machine side weft knuckle two warp yarns interlace with the machine side layer weft; one is a machine side layer warp, and the other is a paper side layer intrinsic warp binder yarn.

In FIG. 2, a weave diagram of the fabric whose cross section is shown in FIG. 1 is provided. In this diagram, the paths of all of the warp yarns making up one repeat the composite forming fabric weave pattern are shown. The paper side layer weft yarns are numbered 1 through 24 at the top of the Figure, and the machine side layer weft yarns are numbered 1' through 12' at the bottom.

The top three lines are exemplary. In the first line, intrinsic warp binder yarn 102 occupies the second segment in the paper side layer between wefts 15 and 21 and interlaces with machine side layer weft yarn 2' beside machine side layer warp yarn 103 at 205. In the second line, machine side layer warp yarn 103 interlaces with machine side layer weft yarns 2' and 9' at 205 and 206 beside intrinsic warp binder yarns 102 and 101 respectively. In the third line, intrinsic warp binder yarn 101 occupies the first segment between wefts 24 and 6, and interlaces with machine side layer weft yarn 9' at 206 beside machine side layer warp yarn 103. It can also be seen that a third segment is located between 203 and 204 and includes wefts 9, 10 11 and 12 where each of intrinsic warp binder yarns 101 and 102 interweaves with the third group of paper side layer weft yarns 9, 10, 11 and 12 to form the third segment. Thus, the first member 102 of the intrinsic warp binder yarn pair interweaves with a third group of weft yarns, the second member 101 of the pair interweaves with the same third group of paper side layer weft yarns, both of the first and second member each independently float over 1 paper side layer weft yarn, and both the first and second pair member together occupy the third segment preserving the weave pattern of the first and second segments. Inspection of the weave diagram in FIG. 2 also shows that there are two wefts in between each segment, e.g. wefts 7 and 8, 13 and 14, and 22 and 23. This recurs through the weave diagram. Also, each intrinsic binder warp yarn 101 and 102 interlaces once with a machine side layer weft within each first and second segment, and a machine side layer warp interlaces the same weft at that point, as indicated at 205 and 206. Neither of the binder warp yarns 101 and 102 interlace with a machine layer weft within the third segment. This common interlacing point also persists though the weave diagram, and moves by two machine side layer weft (which is equivalent to four paper side layer weft) to the right for each set of three warps: e.g. the interlacing point moves from weft 2' to weft 4' in the next set of 3.

It is a characteristic of the fabrics of this invention that the paper side layer weave design must "fit" onto the independent weave structure of the machine side layer. There are two reasons for this. First, the locations at which the paper side layer warp yarns interlace with the machine side layer weft yarns, binding the two structures together, must coincide with the interlacing locations of the machine side layer warp and weft yarns. The weave structures of each fabric layer must therefore be such that this may occur without causing any undue deformation of the paper side surface. Interlacing each paper side layer intrinsic warp binder yarn pair member with one machine side layer weft yarn at the same point that a machine side layer warp yarn interlaces with the same weft assists in recessing the paper side layer warp yarn as far as possible from the exposed machine side surface, known as the wear plane, of the machine side layer, so as to increase fabric wear life. Second, the paper side layer and machine side layer weaves should fit such that the locations at which each of the intrinsic warp binder yarns interlace with the machine side layer wefts can be as far removed as possible from the segment ends within the paper side layer weave pattern. This will reduce or minimize dimpling and any other surface imperfections caused by bringing the paper side layer intrinsic binder warp down into the machine side layer.

Inspection of FIGS. 1 and 2 shows that:

- in the first segment running between 201 and 203, the interlacing point 205 is almost at the middle of the segment underneath paper side layer weft 3,
- in the second segment running between 204 and 201, the interlacing point 206 is again near the middle of the segment underneath paper side layer weft 17,
- in the third segment running between 203 and 204 there is no interlacing of either intrinsic warp binder yarn pair member 101 or 102 with a machine side layer weft, there are two paper side layer weft yarns between each of the three segments, and each third segment is separated by at least one first or second segment from the next third segment.

In FIG. 3 there is shown an alternate embodiment of a fabric according to the present invention. The weave pattern of this fabric is shown in FIG. 4. In this embodiment, the paper side layer is woven according to a 1×1 plain weave pattern in 12 sheds, while the machine side layer is woven according to a 6×12 Barrett design in 6 sheds. The composite fabric is woven using 18 sheds. The weft ratio is 2:1, and the warp ratio is 1:1, bearing in mind that each intrinsic warp binder yarn pair is counted as a single yarn.

Inspection of FIGS. 3 and 4 shows that the unbroken warp path formed in the paper side surface of the paper side layer by intrinsic warp binder yarn pair members 101 and 102 is comprised of three segments. A first full illustrated segment is formed by the interweaving of intrinsic warp binder yarn pair member 101 with a first group of paper side layer weft yarns 23, 24, 1, 2, 3, 4 and 5 so as to occupy a first part of the unbroken warp path. This first segment occupies the portion of the paper side surface from 201 to 203. A second segment is formed by the interweaving of intrinsic warp binder yarn pair member 102 with a second group of paper side layer weft yarns 15, 16, 17, 18, 19, 20 and 21 so as to occupy a second part of the unbroken warp path. This second segment occupies the portion of the unbroken warp path in the paper side surface from 204 to 201 at the right of FIG. 3. A third segment is formed by the interweaving of both the first and second intrinsic warp binder yarn pair members 101 and 102 with a third group of paper side layer weft yarns 7, 8, 9, 10, 11, 12 and 13 so as to occupy a third part of the unbroken warp path in the paper side surface in the paper side layer. This third segment occupies the portion of the unbroken warp path in the paper side surface from 203 to 204.

Starting from the left side of FIG. 3, first intrinsic warp binder yarn pair member 101 passes beneath machine side layer weft yarn 9' at 206 and exchanges positions with warp yarn pair member 102 beneath paper side layer weft 22 at 201. Intrinsic warp binder yarn 101 then forms a first segment of the unbroken warp path in the paper side surface of the paper side layer weave pattern, interweaving with a first group of paper side layer weft yarns 23, 24, 1, 2, 3, 4 and 5 to form a plain weave, 1×1 design. The length of this first segment is 7. The second pair member, intrinsic warp binder yarn 102, interlaces with one machine side layer weft yarn 2' at 205 beside machine side layer warp yarn 103 which also interlaces with the same machine side layer weft yarn 2'. This assists in recessing warp 102 from the wear plane of the fabric, as has been previously described.

A second segment of the unbroken warp path is formed by intrinsic warp binder yarn pair member 102 and occupies that portion of the paper side surface of the paper side layer from 204 to 201 at the right of FIG. 3. Intrinsic warp binder yarn 102 forms a second segment which continues the unbroken plain weave 1×1 pattern of the paper side layer, interweaving with a second group of paper side layer weft yarns 15, 16, 17, 18, 19, 20 and 21. The length of this second segment is thus 7. In the machine side layer beneath this second segment, intrinsic warp binder yarn 101 interlaces with one machine side layer weft yarn 9' at 206 beside machine side layer warp yarn 103 which also interlaces with the same machine side layer weft yarn 9'.

A third segment of the unbroken warp path in the paper side surface of the paper side layer is located between 203 and 204. This third segment is formed by the interweaving of the first intrinsic warp binder yarn pair member 101, together with the second intrinsic warp binder yarn pair member 102, with a third group of paper side layer weft yarns 7, 8, 9, 10, 11, 12, and 13 so as to form a portion of the plain weave, 1×1 design of the paper side layer. It will thus be seen that both the first and second intrinsic warp binder yarn pair members together occupy this third segment of the unbroken warp path. This arrangement is distinct from that of the first and second segments, wherein each is formed solely by one of the intrinsic warp binder yarn pair members. In this third segment, the first member of the intrinsic warp binder yarn pair interweaves with a third group of paper side layer weft yarns, the second member of the pair interweaves with the same third group of paper side layer weft yarns, both the first and second pair members each independently float over 1 consecutive paper side layer weft yarn, and both the first and second pair members together occupy the third segment.

Within this third segment, beginning at 203, intrinsic warp binder yarn pair member 102 passes over paper side layer weft 7, beneath wefts 8, 9 and 10, over 11, and beneath weft 12 and 13 where it passes intrinsic warp binder yarn 101, and then over weft 15 which is the beginning of the next segment. Within this same third segment, intrinsic warp binder yarn 101 passes beneath wefts 7 and 8, over weft 9, beneath wefts 10, 11 and 12 and over weft 13 to continue, together with warp 102, the unbroken warp path. This third segment ends at 204 where warp 101 passes down from the paper side layer to interlace with machine side layer weft 9' at 206 and warp 102 continues the unbroken warp path in the adjacent second segment. The length of the third segment is thus 7, including paper side layer wefts 7, 8, 9, 10, 11, 12 and 13. There is one weft yarn between this third segment and the adjacent first and second segments: weft 6 at the left and weft 14 at the right. There is one first segment running from 201 to 203, and one second segment running from 204 to 201 at the right of FIG. 3, between this third segment and the next third segment (not shown).

Three features of the composite forming fabrics of this invention are visible in this cross section.

First, all of the first, second and third segments are of equal length and are 7. This is not necessary, and other combinations of segment lengths are possible. For example, as shown in the embodiment illustrated in FIGS. 1 and 2, the third segment may be shorter than either the first or second segment. Alternatively, both the first and second segments may be of differing lengths, and neither equal to the third. It is also possible that the length of the third segment may be equal to the length of one of the first or second segments, which are of differing length.

Second, there is one paper side layer weft yarn between each of the first, second and third segments. In FIGS. 3 and 4, these are: weft 22 between a second and first segment, weft 6 between a first and third segment, and weft 14 between a third and second segment. Depending on the weave design chosen for the paper side layer, there may be either of one, two or three paper side layer weft yarns between each of the segments, but there must be at least one intervening yarn.

Third, each of the intrinsic warp binder yarn pair members 101 and 102 passes beneath and interlaces with separate machine side layer weft yarns which are located at different points in the weave pattern of the machine side layer. In this fabric, all of the interlacing points are chosen to coincide with separate knuckles formed by the interlacing of the machine side layer weft yarns with the machine side layer warp yarns. Within each repeat of the composite fabric weave pattern, at every machine side weft knuckle, two warp yarns interlace with the machine side layer weft yarn: one is a machine side layer warp yarn and the other is one member of a pair of intrinsic binder warp yarns.

A weave diagram of the fabric shown in FIG. 3 is provided in FIG. 4. The paths of all of the intrinsic warp binder yarns making up the composite forming fabric are shown in this diagram. The paper side layer weft yarns are numbered 1 through 24 at the top of the Figure, while the machine side layer weft yarns are numbered 1' through 12' at the bottom. The first three lines at the top of FIG. 4 coincide with the cross sectional illustration of FIG. 3.

In the first line, intrinsic warp binder yarn 102 occupies the second segment in the paper side layer between wefts 15 and 21 and interlaces with machine side layer weft yarn 2' beside machine side layer warp yarn 103 at 205. In the second line, machine side layer warp yarn 103 interlaces with machine side layer weft yarns 2' and 9' at 205 and 206 respectively. In the third line, intrinsic warp binder yarn 101 occupies the first segment between weft 23 and 5, and interlaces with machine side layer weft 9' at 206 beside machine side layer warp yarn 103. Inspection of the first and third lines (corresponding to the paths of intrinsic warp binder yarns 102 and 101 respectively) shows that a third segment is located between 203 and 204 and includes weft yarns 7, 8, 9, 10, 11, 12 and 13 where each of intrinsic warp binder yarns 101 and 102 alternately forms a knuckle with paper side layer weft yarns 9 and 13, and 7 and 11 respectively to form a portion of this third segment. Thus, the first member of the warp yarn pair, e.g. 102, interweaves with a third group of weft yarns, the second member of the pair e.g. 101, interweaves with the same third group of paper side layer weft yarns, both of the first and second member each independently float over 1, 2 or 3 consecutive paper side layer weft yarns, and both the first and second pair member together occupy the third segment. Inspection of the weave diagram in FIG. 4 also shows that there is one weft in between each segment, e.g. wefts 6, 14, and 22. This recurs through the weave diagram. Also, each intrinsic warp binder yarn 101 and 102 interlaces once with a machine side layer weft within each of a first and second segment, and a machine side layer warp interlaces the same weft at that point, as indicated at 205 and 206. This common interlacing point also persists though the weave diagram, and moves by two machine side layer weft (which is equivalent to four paper side layer weft) to the right for each set of three warps: e.g. the interlacing point moves from weft 2' to weft 41 in the next set of 3.

Experimental Trials

Two sample fabrics were woven according to the designs illustrated in the Figures. Sample fabric A was woven according to the design shown in FIGS. 1 and 2. Sample fabric B was woven according to the design illustrated in FIGS. 3 and 4. Both fabrics were woven using standard round polyester warp and weft yarns. The sample fabrics had the following properties:

TABLE 2

| Fabric Property | Sample A | Sample B |
|---|---|---|
| PS Mesh (warp × weft per cm) | 27.2 × 31.5 | 27.2 × 35.4 |
| MS Mesh (warp × weft per cm) | 27.2 × 15.75 | 27.2 × 17.7 |
| Yarn Diameter PS warp (mm) | 0.13 | 0.13 |
| Yarn Diameter MS warp (mm) | 0.17 | 0.17 |
| Yarn Diameter PS weft (mm) | 0.13 | 0.13 |
| Yarn Diameter MS weft (mm) | 0.33 | 0.28 |
| Open Area (%) | 45.2 | 34.9 |
| Warp Fill (Before heat setting) | 106 | 106 |
| Warp Fill (After heat setting) | 117 | 117 |
| Frames $cm^{-2}$ | 570.4 | 962.6 |
| Fiber Support Index (Beran) | 137 | 166 |
| Air Permeability ($m^3/m^2/hr$) | 7,720 | 6,000 |

In Table 2, PS means "paper side", MS means "machine side", Open Area is measured according to the procedure provided in CPPA Data Sheet G-18 and refers to the portion of the paper side surface of the paper side layer that does not contain warp or weft yarns and is therefore open to allow for drainage of fluid from the web, Warp Fill=(warp diameter× mesh×100)%, Frames $cm^{-2}$ refers to the number of openings, or frames, in one square centimetre of the paper side surface of the paper side layer, Fiber Support Index is determined according to the relationship provided in CPPA Date Sheet G-18 and refers to amount of support provided by the paper side surface of the paper side layer available to support the papermaking fibers in the stock deposited thereon. Air permeabilities were measured according to ASTM D 737-96, using a High Pressure Differential Air Permeability Machine, available from The Frazier Precision Instrument Company, Gaithersburg, Md., USA, and with a pressure differential of 127 Pa through the fabric; the air permeability is measured on the fabric after heat setting.

Selection of appropriate warp and weft yarn diameters for use in the fabrics of this invention will depend on many factors, including the grade of paper product which the fabric will be used to produce and will affect the air permeability of the resulting fabric. Selection of appropriate yarn diameters will be made in accordance with the intended end use of the fabric.

From Table 2 above, it can be seen that the fabrics of this invention provide a relatively high open area, from 35% to 45% for the examples given. This high open area allows fluids to drain easily and uniformly from the incipient paper web into the fabric structure below. Further, the fabrics possess a relatively low air permeability, of from 7,720 down to 6,000 $m^3/m^2/hr$ in the sample fabrics for which data is given in Table 2. Fabric air permeability may be further reduced by appropriate choice of paper side and/or machine side yarn diameter and mesh. By reducing fabric air permeability, fluid drains more slowly through both the paper and machine side fabric layers, which result in improved formation and reduced wire mark. Laboratory analysis of hand sheets produced on the fabric samples described in Table 2 confirms that wire mark is reduced compared to other prior art fabrics, and that the sheets offer improved printability characteristics.

What is claimed is:

1. A composite forming fabric comprising in combination a paper side layer having a paper side surface, a machine side layer, and paper side layer intrinsic warp binder yarns which bind together the paper side layer and the machine side layer, wherein:

(i) the paper side layer and the machine side layer each comprise warp yarns and weft yarns woven together in a repeating pattern, and the paper side layer and the machine side layer together are woven in at least 6 sheds;

(ii) in the paper side layer all of the warp yarns comprise pairs of intrinsic warp binder yarns;

(iii) in the paper side surface of the paper side layer the repeating pattern provides a warp yarn path in which the paper side layer warp yarn floats over 1, 2 or 3 consecutive paper side layer weft yarns;

(iv) each of the pairs of intrinsic warp binder yarns occupy the unbroken warp path in the paper side layer;

(v) the ratio of paper side layer weft yarns to machine side layer weft yarns is chosen from 1:1, 2:1, 3:2, and 3:1; and (vi) the ratio of paper side layer warp yarns to machine side layer warp yarns is chosen from 1:1 to 3:1; and wherein the pairs of intrinsic warp binder yarns comprising all of the paper side layer warp yarns are woven such that:

(a) in a first segment of the unbroken warp path:

(1) the first member of the pair interweaves with a first group of paper side layer wefts to occupy a first part of the unbroken warp path in the paper side surface of the paper side layer;

(2) the first member of the pair floats over 1, 2 or 3 consecutive paper side layer weft yarns; and (3) the second member of the pair interlaces with one weft yarn in the machine side layer beside a machine side layer warp yarn that interlaces with the same machine side layer weft yarn;

(b) in a second segment of the unbroken warp path:

(1) the second member of the pair interweaves with a second group of paper side layer wefts to occupy a second part of the unbroken warp path in the paper side surface of the paper side layer;

(2) the second member of the pair floats over 1, 2 or 3 consecutive paper side layer weft yarns; and (3) the first member of the pair interlaces with one weft yarn in the machine side layer beside a machine side layer warp yarn that interlaces with the same machine side layer weft yarn;

(c) in a third segment of the unbroken warp path:

(1) the first member of the pair interweaves with a third group of paper side weft yarns;

(2) the second member of the pair interweaves with the same third group of paper side weft yarns;

(3) both the first member and the second member each independently float over 1, 2 or 3 consecutive paper side weft yarns; and (4) both the first member and the second member together occupy a third part of the unbroken warp path;

(d) in the paper side layer the unbroken warp path includes at least one first segment, at least one second segment, and at least one third segment, and at least one first or second segment is located between each of the third segments;

(e) the first, second and third segments are of equal or unequal length;

(f) the unbroken warp path in the paper side surface of the paper side layer occupied in turn by the first and the second member of each pair of intrinsic warp binder yarns has a single repeat pattern;

(g) in the unbroken warp path in the paper side surface of the paper side layer occupied in turn by the first and second members of each pair of intrinsic warp binder yarns, each succeeding segment is separated in the paper side surface of the paper side layer by at least one paper side layer weft yarn; and (h) in the composite fabric the weave pattern of the first member of a pair of intrinsic warp binder yarns is the same, or different, to the weave pattern of the second member of the pair.

2. A fabric according to claim 1 wherein the paper side layer unbroken warp path includes three segments, and each segment occurs once within each complete repeat of the composite forming fabric weave pattern.

3. A fabric according to claim 1 wherein the paper side layer unbroken warp path includes six segments, and each segment occurs twice within each complete repeat of the composite forming fabric weave pattern.

4. A fabric according to claim 1 wherein in the paper side layer unbroken warp path each segment is separated from the next segment by either 1, 2 or 3 paper side layer weft yarns.

5. A fabric according to claim 4 wherein in the paper side layer unbroken warp path each segment is separated from the next segment by 1 or 2 paper side layer weft yarns.

6. A fabric according to claim 5 wherein in the paper side layer unbroken warp path each segment is separated from the next segment by 1 paper side layer weft yarn.

7. A fabric according to claim 5 wherein in the paper side layer unbroken warp path each segment is separated from the next segment by 2 paper side layer weft yarns.

8. A fabric according to claim 1 wherein within the paper side layer weave pattern, the segment lengths of the first, second and third segments of each of a pair of intrinsic warp binder yarns occupying the unbroken warp path are identical.

9. A fabric according to claim 1 wherein within the paper side layer weave pattern, the segment lengths of the first, second and third segments of each of a pair of intrinsic warp binder yarns occupying the unbroken warp path are not identical.

10. A fabric according to claim 9 wherein the first and second segment lengths are the same, and the third segment length is different.

11. A fabric according to claim 9 wherein the first and third segment lengths are the same, and the second segment length is different.

12. A fabric according to claim 9 wherein the second and third segment lengths are the same, and the first segment length is different.

13. A fabric according to claim 1 wherein within the composite fabric weave pattern the paths occupied by each of a pair of paper side layer intrinsic warp binder yarns are the same, and the interlacing points between the intrinsic warp binder yarns with the machine side layer wefts are regularly spaced, and are the same distance apart.

14. A fabric according to claim 1 wherein within the composite fabric weave pattern the paths occupied by each of a pair of paper side layer intrinsic warp binder yarns are the not same, and the interlacing points between the intrinsic warp binder yarns with the machine side layer wefts are not regularly spaced, and are not the same distance apart.

15. A fabric according to claim 1 wherein within the composite fabric the weave design is chosen such that:

(1) the first, second and third segment lengths in the paper side layer are the same, and the interlacing points between the intrinsic warp binder yarns with the machine side layer wefts are regularly spaced; or (2) the first, second and third segment lengths in the paper side layer are the same, and the interlacing points between the intrinsic warp binder yarns with the machine side layer wefts are not regularly spaced, and are not the same distance apart; or (3) the first, second and third segment lengths in the paper side layer are not the same, and the interlacing points between the intrinsic warp binder yarns with the machine side layer wefts are not regularly spaced, and are not the same distance apart; or (4) the first and second segment lengths in the paper side layer are the same, and are different from the third segment length, and the interlacing points between the intrinsic warp binder yarns with the machine side layer wefts are regularly spaced; or (5) the first and second segment lengths in the paper side layer are the same, and are different from the third segment length, and the interlacing points between the intrinsic warp binder yarns with the machine side layer wefts are not regularly spaced; or (6) the first and third segment lengths are the same, and are different from the second segment length, and the interlacing points between the intrinsic warp binder yarns with the machine side layer wefts are regularly spaced; or (7) the first and third segment lengths are the same, and are different from the second segment length, and the interlacing points between the intrinsic warp binder yarns with the machine side layer wefts are not regularly spaced, or (8) the second and third segment lengths are the same, and are different from the first segment length, and the interlacing points between the intrinsic warp binder yarns with the machine side layer wefts are regularly spaced; or (9) the second and third segment lengths are the same, and are different from the first segment length, and the interlacing points between the intrinsic warp binder yarns with the machine side layer wefts are not regularly spaced.

16. A fabric according to claim 1 wherein the paper side layer weave pattern is chosen from the group consisting of a plain 1×1 weave; a 1×2 weave; a 1×3 weave; a 1×4 weave; a 2×2 basket weave; a 3×6 weave; a 4×8 weave; a 5×10 weave; and a 6×12 weave.

17. A fabric according to claim 1 wherein the weave design of the machine side layer is chosen from an unsymmetrical N×2N design, a satin and a twill design.

18. A fabric according to claim 1 wherein the ratio of the number of paper side layer weft yarns to machine side layer weft yarns in the composite forming fabric is chosen from the group consisting of 1:1, 2:1, 3:2 or 3:1.

19. A fabric according to claim 1 wherein the ratio of paper side layer warp yarns to machine side layer warp yarns is either 1:1, 2:1 or 3:1.

20. A fabric according to claim 1 wherein the ratio of paper side layer weft yarns to machine side layer weft yarns is 2:1.

21. A fabric according to claim 1 wherein the ratio of paper side layer weft yarns to machine side layer weft yarns is 3:2.

22. A fabric according to claim 1 wherein the ratio of paper side layer warp yarns to machine side layer warp yarns is 1:1.

23. A fabric according to claim 1 wherein the yarn diameters are chosen to provide after heat setting an air permeability when measured by a standard test procedure of from about 3,500 $m^3/m^2/hr$ to about 8,200 $m^3/m^2/hr$, and a paper side layer paper side surface open area when measured by a standard test procedure of at least about 35%.

24. A fabric according to claim 1 having before heat setting a warp fill of from about 100% to about 125%.

25. A fabric according to claim 1 having after heat setting a warp fill of from about 110% to about 140%.

26. A fabric according to claim 1 wherein the yarn diameters are chosen to provide after heat setting an air permeability when measured by a standard test procedure of from about 3,500 $m^3/m^2/hr$ to about 8,200 $m^3/m^2/hr$, a paper side layer paper side surface open area when measured by a standard test procedure of at least about 35%, and a warp fill before heat setting of from about 100% to about 125%.

27. A fabric according to claim 1 wherein the yarn diameters are chosen to provide after heat setting an air permeability when measured by a standard test procedure of from about 3,500 $m^3/m^2/hr$ to about 8,200 $m^3/m^2/hr$, a paper side layer paper side surface open area when measured by a standard test procedure of at least about 35%, and a warp fill after heat setting of from about 110% to about 140%.

* * * * *